US007927162B1

(12) United States Patent
Doubleday

(10) Patent No.: US 7,927,162 B1
(45) Date of Patent: Apr. 19, 2011

(54) MULTI-FUNCTIONAL, PERSONAL FLOTATION DEVICE

(76) Inventor: Marc D. Doubleday, Cary, IL (US)

( * ) Notice: Subject to any disclaimer, the term of this patent is extended or adjusted under 35 U.S.C. 154(b) by 161 days.

(21) Appl. No.: 12/433,924

(22) Filed: May 1, 2009

(51) Int. Cl.
*B63C 9/20* (2006.01)

(52) U.S. Cl. ..... 441/89; 441/116; 441/118

(58) Field of Classification Search ..... 441/88, 441/89, 90, 96, 99, 102, 106, 107, 108, 116, 441/118
See application file for complete search history.

(56) References Cited

U.S. PATENT DOCUMENTS

| | | | | |
|---|---|---|---|---|
| 156,443 | A | 11/1874 | Stoner | |
| 278,240 | A | 5/1883 | Hunt | |
| 3,095,568 | A | 6/1963 | Aine et al. | |
| 3,877,096 | A * | 4/1975 | Scesney | 441/6 |
| 5,326,297 | A * | 7/1994 | Loughlin | 441/89 |
| 5,736,954 | A * | 4/1998 | Veazey | 441/89 |
| 5,759,076 | A | 6/1998 | Bateman et al. | |
| 5,855,497 | A * | 1/1999 | French | 441/118 |
| 5,911,612 | A * | 6/1999 | Steger | 441/118 |
| 6,203,390 | B1 * | 3/2001 | Elliott | 441/89 |
| 6,368,174 | B1 * | 4/2002 | Magee | 441/89 |

FOREIGN PATENT DOCUMENTS

DE 41 15 206 12/1992

* cited by examiner

*Primary Examiner* — Lars A Olson
(74) *Attorney, Agent, or Firm* — Donald J. Ersler

(57) ABSTRACT

A multi-functional, personal flotation device provides a life preserver for a person in combination with an integrated tethering system to aid in retrieval of the wearer. The integrated tethering system may be used alone or in conjunction with an integrated signaling device. The integrated signaling device extends when the life preserver is use. The integrated tethering system facilitates the recovery of a person wearing the multi-functional, personal flotation device. The integrated signaling device or the integrated tethering system may also include a sound or a visual alarm.

21 Claims, 14 Drawing Sheets

MULTI-FUNCTIONAL, PERSONAL FLOTATION DEVICE

BACKGROUND OF THE INVENTION

1. Field of the Invention

The present invention relates generally to personal flotation devices and more particularly to a multi-functional, personal flotation device providing personal flotation support with an integrated signaling device and/or an integrated tethering device.

2. Discussion of the Prior Art

Quite commonly, emergency situations arise where an individual is in a body of water, and requires rescue or retrieval of that individual therefrom. While these incidents are commonly known in the boating and maritime community as Man Overboard (hereafter sometimes referred to as MOB) situations, it must be noted that individuals in the water can originate from sources other than water craft. Other sources include fixed structures such as piers, docks and jetties; and also aircraft, such as airplanes and helicopters. Regardless of the source of danger, a MOB is clearly a life threatening situation, and considerable safety equipment is well known in the art to affect rescue of the individual. The rescue of a MOB requires several sequential procedures. Such procedures include, but are not limited to, keeping the MOB afloat, locating the MOB, obtaining control of the MOB by the rescuer and recovery of the MOB by removal from the water to a safe location whether a rescue boat, fixed structure or aircraft.

Methods to keep a MOB afloat frequently use a life jacket (also known as a PDF or PERSONAL FLOTATION DEVICE). The life jackets include both fixed buoyancy life jackets and inflatable life jackets. In particular, inflatable life jackets have been well known in the art for more than a century, for example, U.S. Pat. No. 278,240 to Hunt, incorporated herein by reference. More recently, inflatable life jackets have become more compact, comfortable, and reliable thereby increasing use. Modern Personal Flotation Devices (or PFD) often employ inflation mechanisms utilizing a canister of compressed gas, typically carbon dioxide. The inflation of the PFD may be triggered manually by the user or automatically on contact with water or submersion. PFDs are often of the United States Coast Guard Class III variety, which will rotate an unconscious or otherwise incapacitated MOB to a face up position. This maneuver keeps the face out of the water and improves the individual's chances for survival. This action, coupled with automatic inflation, provides a particularly useful PFD that greatly improves chances of survival until being located and rescued; especially if the MOB is unconscious or otherwise incapacitated.

Finding the location of a MOB is particularly difficult in all but the most calm conditions, since only a portion of the person's body is floating above the water. These situations are further complicated by wave motion, which can often obscure the MOB completely. Storms and fogs can also make the problem of finding individuals lost at sea even more difficult. This difficulty has been recognized in the art for more than 125 years, for example, the device of U.S. Pat. No. 156,443 by Stoner, incorporated herein by reference; and a number of other signaling devices have been disclosed in the intervening time. These are typically of two types: flags or pennants atop masts (fixed, extendible or flexible), or inflatable devices, for example, U.S. Pat. No. 3,877,096 by Scesney, incorporated herein by reference.

It is also well recognized in the art that these inflatable signaling masts can be integrated with a flotation device and used to erect radio signaling antennas, for example, U.S. Pat. No. 3,095,568 by Aine et al, or visual signaling elements including luminous coloring, lights or light reflective material, for example German Patent 41 15 206 by Essler, 1992. These signaling devices can increase visibility of the user, thus improving the probability of the person or MOB being located.

Once located, the MOB needs to be brought under control by the rescuer in order to facilitate recovery. Often this involves a rescue boat, but can otherwise be a person from a fixed structure or aircraft such as a helicopter. Most rescues typically involve a boat that comes along side the MOB with an attempt made to gain control of the MOB and then recover them on to the boat. Extraction from the water is the most harrowing and hazardous part of the rescue for both the rescuer and the MOB because of the relative motion between the boat and the MOB, in particular if the MOB is unconscious or otherwise incapacitated. If the MOB is alert and responsive, a line or rope can be thrown to the MOB and the MOB can be brought close alongside the rescue vessel in order to continue with the recovery onboard.

However, if the MOB is unconscious or otherwise incapacitated, the boat must be brought close alongside the MOB and an attempt made to grab or gain control of that person. This is particularly dangerous for the rescuer who must often lean out and over the side of the pitching and yawing boat to get a hold of the MOB. With the MOB alongside the boat, there is also a clear possibility that pitching and yawing of the boat may cause the boat to crash down upon the MOB, thereby causing further injury. Another problem can occur if the rescuer is tossed from the boat, thereby becoming an additional man overboard (MOB). With two people overboard, the rescue situation becomes even more complicated.

Alternatively, the rescuer may attempt to retrieve the MOB using a grappling device, such as a boat hook, to catch part of the MOBs clothing or PFD. This poses considerable additional risk to the MOB who may be struck by the hook due to the lack of control caused by the relative motion between the boat and the MOB.

There are many devices and techniques to recover the MOB onto the boat, fixed structure or aircraft. Often, an additional flotation device with a tether attached is thrown to the MOB who positions them self within the device. The tether can then be used to lift or hoist the MOB on board, for example, by using a halyard on a sailboat. Tether devices are well known in the art and include examples such as the Lifesling® Man Overboard Recovery System (Sailing Foundation, Seattle Wash.) and the MOM8—Man Overboard Module (Survival Technologies Group, Trenton N.J.). These devices require a MOB to be conscious and capable of positioning themselves within the recovery float or harness. They are of extremely limited usefulness if the MOB is unconscious or otherwise incapacitated.

Inflatable PFDs are well known in the art with many manufacturers and brands, including Mustang Survival of Bellingham, Wash.; Revere Survival Products, Jacksonville, Fla.; and Jarden Corporation, Eye, N.Y., among others. In general, all of these PFDs typically are formed with one or more buoyancy chambers that are made of a sealed, gas tight material and are most frequently inflated utilizing a canister of compressed gas, typically carbon dioxide. The inflation of the PFD may be triggered manually by the user or automatically on contact with water or submersion. In their uninflated state, the buoyancy chambers often fold upon themselves thereby offering the advantages of being relatively compact, light weight, and comfortable to wear.

In addition to the buoyancy chambers, these inflatable PFDs often include a belt or harness system, typically made of nylon strapping with one or more buckles to attach the buoyancy chambers to the wearer and allow for flotation of the wearer once the chambers are inflated. A most secure attachment system utilizes a crotch strap. Particular details of the underlying PFD are not important as long as they encompass one or more inflatable buoyancy chambers and a harness or belting system to secure the buoyancy chambers to the wearer.

It can be seen that while considerable attention has been paid in the art to keeping an MOB afloat and locating a MOB, significant improvement needs to be made in gaining control of the MOB by the rescuer and facilitating recovery of the MOB by the rescuer, in particular if the MOB is unconscious or otherwise incapacitated. Thus, many improvements in a personal flotation device can add greatly to the efficiency of the retrieval of a man overboard.

Adding these additional devices to the personal flotation device is best accomplished without substantially increasing the bulk of the personal flotation device. If the advantages of the additional devices can be incorporated with minimized additional bulk, great advantages can be obtained.

SUMMARY OF THE INVENTION

It is an object of the present invention to provide an improved means of gaining control of a MOB utilizing an inflatable PFD incorporating an integral tether which is deployed with the inflation of the PFD or alternatively incorporated onto a mast device that is automatically deployed along with inflation of the buoyancy chambers, allowing for elevation and extension of a tether system that facilitates easier and safer control of the MOB by the rescuer.

Among the many objectives of the present invention is the provision of a multi-functional, personal flotation device.

Another objective of the present invention is the provision of a multi-functional, personal flotation device, with an integrated tether.

Still another objective of the present invention is the provision of a multi-functional, personal flotation device, with an integrated mast.

An additional objective of the present invention is the provision of a multi-functional, personal flotation device, with an integrated signaling device.

Yet another objective of the present invention is the provision of a multi-functional, personal flotation device, with a folding signaling device and attached tether.

Yet another objective of the present invention is the provision of an improved device for gaining control and recovery of a person overboard.

A final objective of the present invention is the provision of an improved method for recovery of a person overboard by the rescuer.

These and other objectives of the invention (which other objectives become clear by consideration of the specification, claims and drawings as a whole) are met by providing a multi-functional, personal flotation device, providing a life vest for a person with an integrated tether or mast having a signaling device and a tether integrated therewith.

BRIEF DESCRIPTION OF THE DRAWINGS

Throughout the figures of the drawings, where the same part appears in more than one figure of the drawings, the same number is applied thereto.

DETAILED DESCRIPTION OF THE PREFERRED EMBODIMENTS

Figure 1:
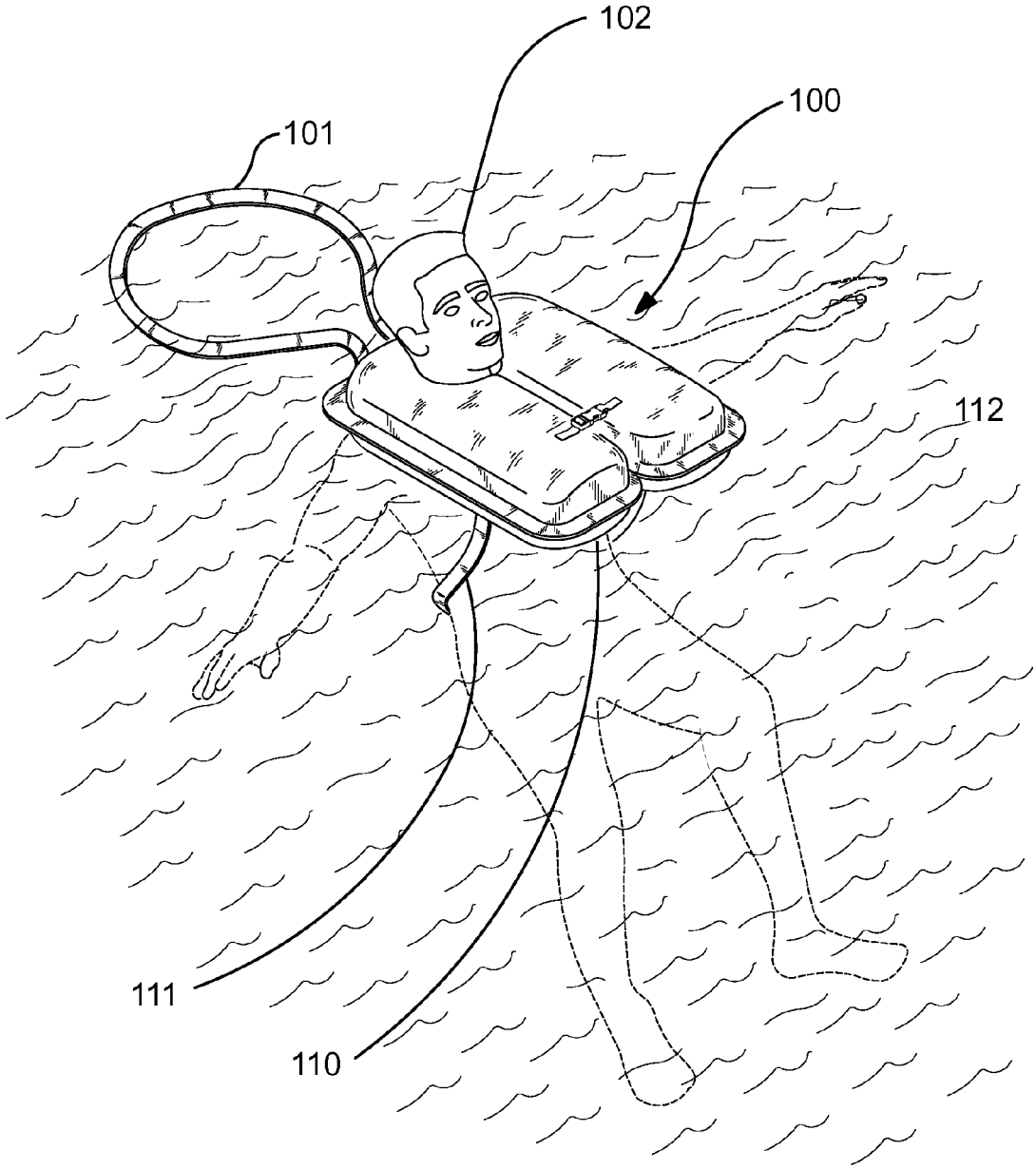
FIG. 1 depicts a perspective view of a multi-functional, personal flotation device in its most simple format with an integrated tether in a deployed position.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale.

For purposes of convenience and clarity only, directional terms such as top, bottom, left, right, up, over, above, below, beneath, rear, and front, may be used with respect to the drawings. These and similar to directional terms are not to be construed to limit the scope of the invention in any manner. The words attach, connect, couple, and similar terms with their inflectional morphemes do not necessarily denote direct or intermediate connections, but may also include connections through mediate elements or devices.

The subject of the current invention provides a multi-functional, personal flotation device providing personal support with an integrated tethering device or system. In the preferred embodiment, the integrated tethering device is incorporated with an integrated signaling device to extend the tether away from the user. As a person is using the multi-functional, personal flotation device of this invention, a mast of the integrated signaling device extends from the main flotation device or life preserver. Within or upon this mast, may be a visual, radio, or an audio signaling device. Also, the mast includes a tether as a part of the tethering system in order to facilitate moving or lifting of the person wearing the multi-functional, personal flotation device.

On the multi-functional, personal flotation device is a main flotation device or life preserver designed to support the body of a person in a body of water. As the main flotation device or life preserver inflates, the integrated tether is deployed, or in the preferred embodiment, the mast assembly of the integrated signaling device and integrated tethering device inflates and extends above the person in the water. This mast renders it easier for a person to be spotted in the water.

Optionally, an audio, radio, or visual device can additionally be attached on the mast in order to facilitate location of a person wearing the multi-functional, personal flotation device. To that end, the main flotation device becomes more efficient at spotting and retrieval of the wearer. Also, with the tether attached to mast and extending above the MOB, a person can be much more easily brought under control and be removed from the water more efficiently.

This invention provides an improved method and device for gaining control and recovery of a MOB, utilizing an inflatable PFD incorporating an integral tether that is automatically deployed along with inflation of the buoyancy chambers allowing for easier and safer control of the MOB by the rescuer. In the preferred embodiment, a mast device automatically deploys along with inflation of the buoyancy chambers that provides for both increased signaling and elevation and extension of a tether system that further facilitates gaining control and recovery of a MOB.

Broadly, the preferred embodiment of the present invention relates to an inflatable PFD comprising an inflatable tube that acts as a mast and is integral to the PFD and attached to one or more buoyancy chambers with fluid communication such that the tube is automatically deployed and inflated along with inflation of the buoyancy chamber or chambers. The inflatable tube may be cylindrical in nature, that is with sides parallel along the length of the tube or the tube may be slightly conical, that is with the sides tapering together along the length of the tube. A conical tube has the advantage of slightly less bulk without a significant decrease in stability. The top, extended portion of the tube is fitted with a looped tether, preferably made of webbing material (for example nylon), that is securely attached at its other end to the harness typically secured around the MOB. The tether loop which is automatically elevated and extended away from the MOB with inflation of the buoyancy chambers and provides a convenient and safer means for the rescuer to gain control of the MOB.

This invention also provides a folding method for the tube in the deflated state to lay relatively flat against the deflated buoyancy chamber, minimizing the profile of the inflatable tube while allowing for an attached cross member at the top of the mast to support the loop of the tether thereby maintaining the compact and comfortable fit of the PFD.

Preferably, the inflatable tube is of highly visible color and may have highly reflective material (for example Solas reflective tape, from the 3M Company, St. Paul, Minn.) or an automatically activated light near the top of the tube to aid in visibility, particularly in low light conditions.

Referring now to FIG. 1, the personal flotation device 100 of the present invention is shown in its fully deployed position on wearer 102, who is floating in a body of water 112. The personal flotation device 100 has an inflatable life preserver 110 with a harness belt 111 and a looped tether 101 in a deployed position.

Figure 21:
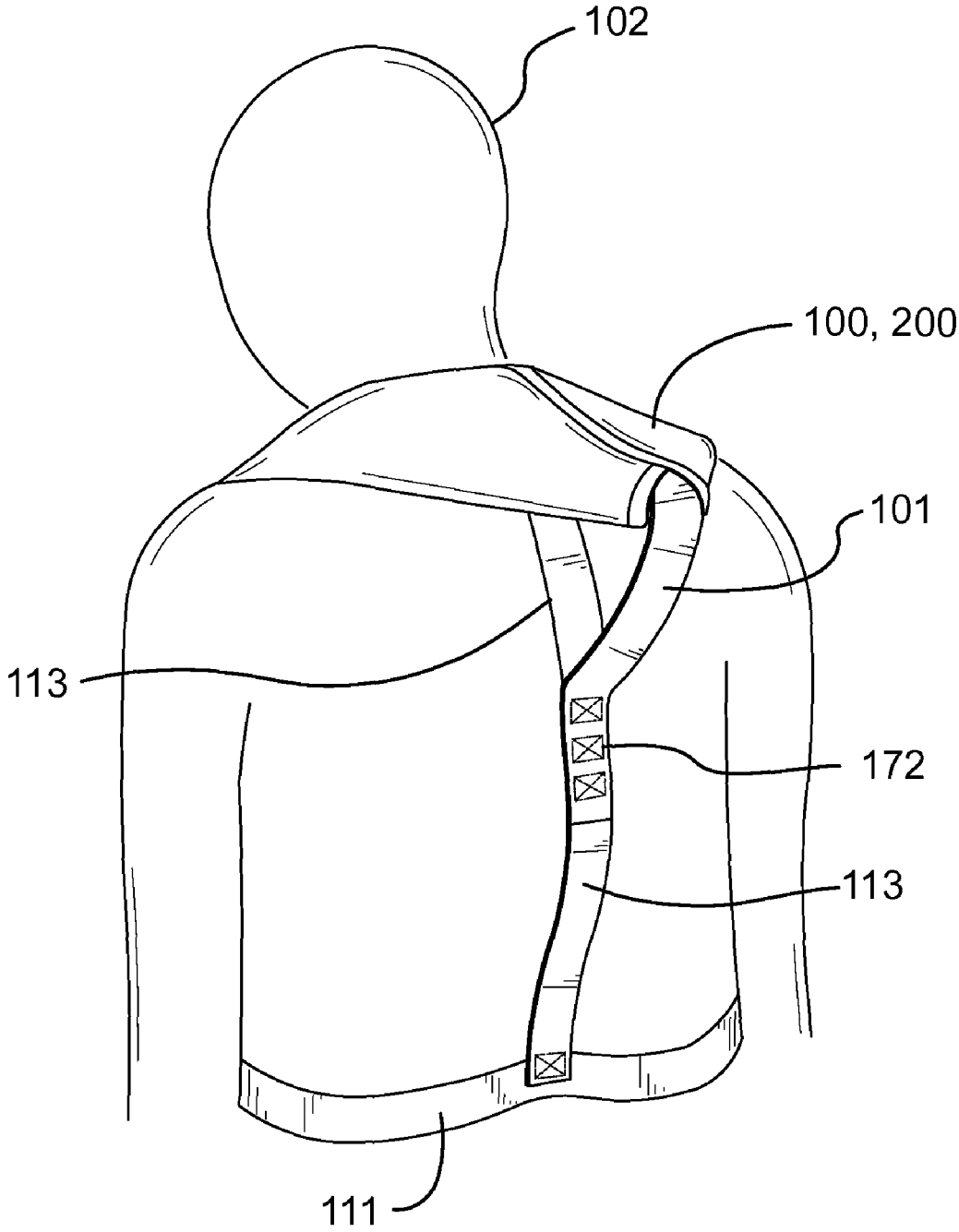
FIG. 21 depicts a rear perspective view of an uninflated personal flotation device attached to a user.

The tether 101 is securely and permanently fastened to preferably the back strap 113 of the harness belt 111 of the personal flotation device 100 as shown in FIG. 21. As the personal flotation device 100 inflates and opens, the tether 101 is released from the PFD and is deployed in the water to facilitate grabbing of the tether 101 by a hand or a mechanical means, such as a boat hook (not shown).

Figure 2:
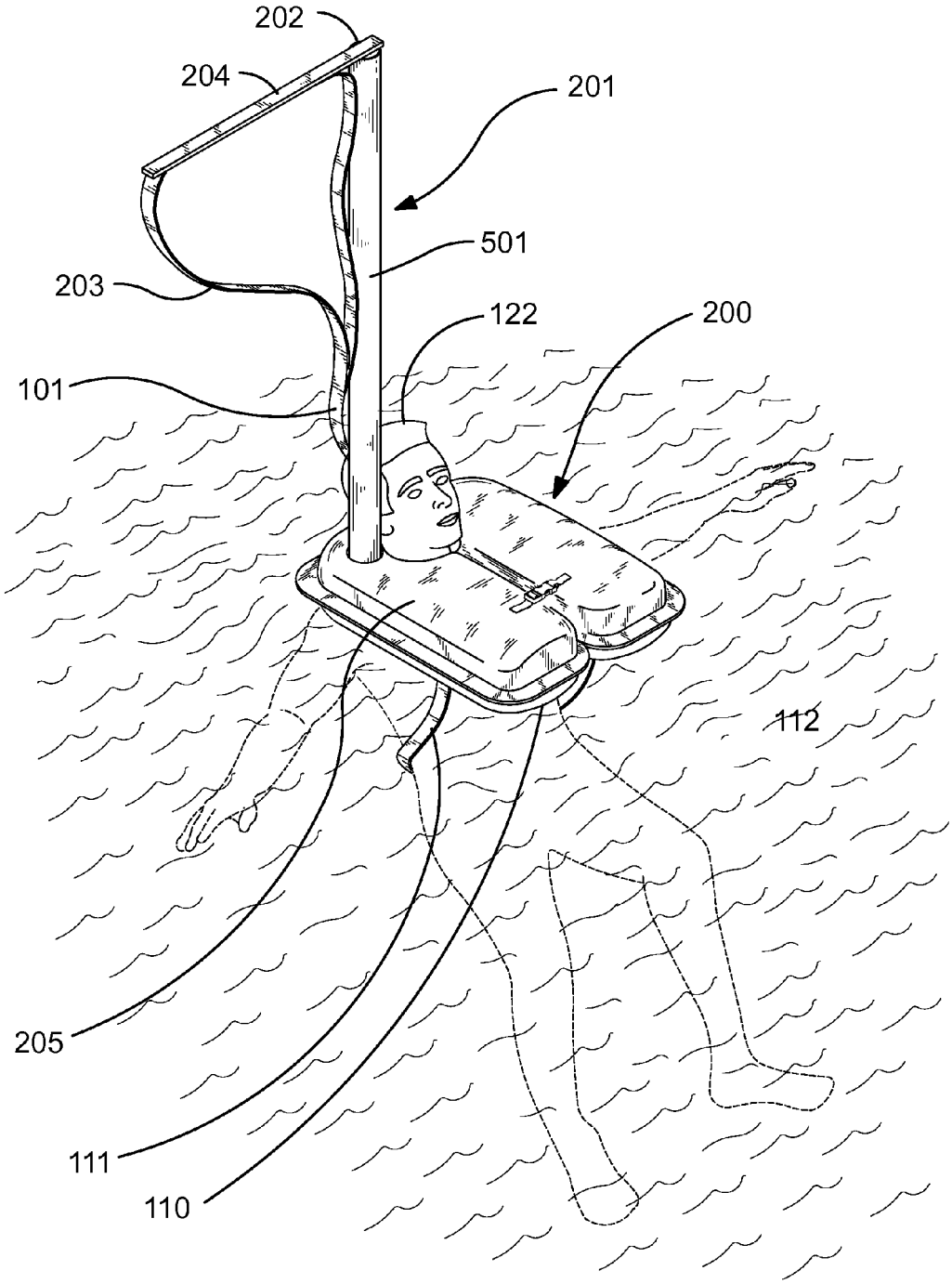
FIG. 2 depicts a perspective view of a multi-functional, personal flotation device with an integrated signaling and tether support mast in a deployed position.

Referring now to FIG. 2, the preferred personal flotation device 200 is shown in a fully deployed position on wearer 102, who is floating in a body of water 112. The personal flotation device 200 has an inflatable life preserver 110 with the harness belt 111. The mast tube assembly 201 is mounted on the life preserver 110 and shown as standing in an approximately vertical position.

Figure 3:
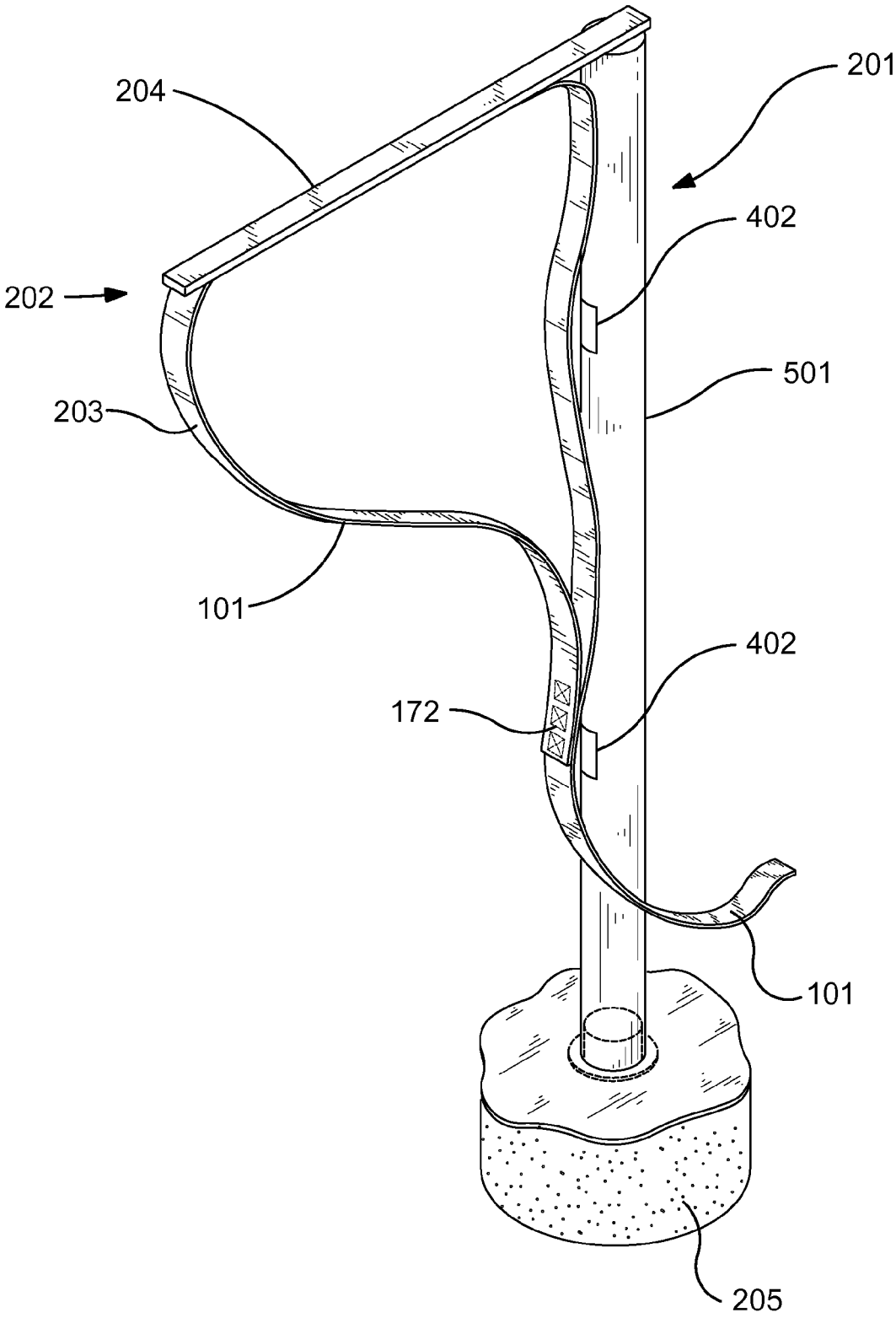
FIG. 3 depicts a perspective view of an assembled integrated signaling and tether support mast with integrated mast head and cross member; and integrated tether and a tether loop for the multi-functional, personal flotation device in a deployed position.

Also shown on the upper end of the mast tube assembly 201 is the cross member assembly 202, the loop 203 of the tether 101 with the opposite end of the tether loop 101 being securely and permanently fastened preferably to the back strap 113 of the harness belt 111 of the personal flotation device 200. With reference to FIG. 3, a suitable cross member assembly 202 with a cross member 204 formed on a top of an integrated signaling and tether support mast 501 is elevated as a buoyancy chamber 205 of the life preserver 110 for the personal flotation device 200 inflates and opens the tether 101 at loop 203 to facilitate grabbing of the loop 203 by a hand or a mechanical means, such as a boat hook (not shown).

With further reference to FIG. 3, the inflatable mast tube assembly 201 is permanently attached in a gas tight manner to one of the buoyancy chambers 205 of the personal flotation device 200 forming a gas communication channel so that the inflatable mast tube assembly 201 will inflate along with the buoyancy chamber 205.

The inflatable mast tube 501 can be made from of a strong, flexible plastic material such as vinyl or a cloth suitably coated to render it essentially gas proof. Such coated cloths include urethane coated nylon cloth or vinyl coated polyester cloth among others. There are many other suitable gas tight plastics and coated fabrics well known to those in the art of PFD design and manufacturing.

Figure 6:
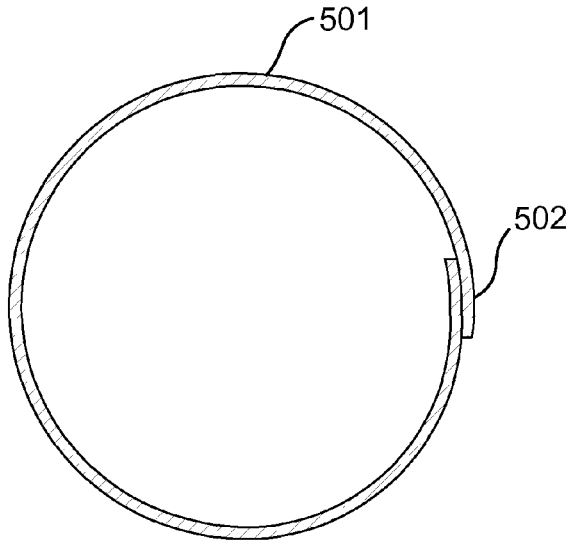
FIG. 6 depicts a top cross section cut along line 6-6 in FIG. 5 of a mast tube for a mast tube assembly made by a lap seam for a multi-functional, personal flotation device.
Figure 8:
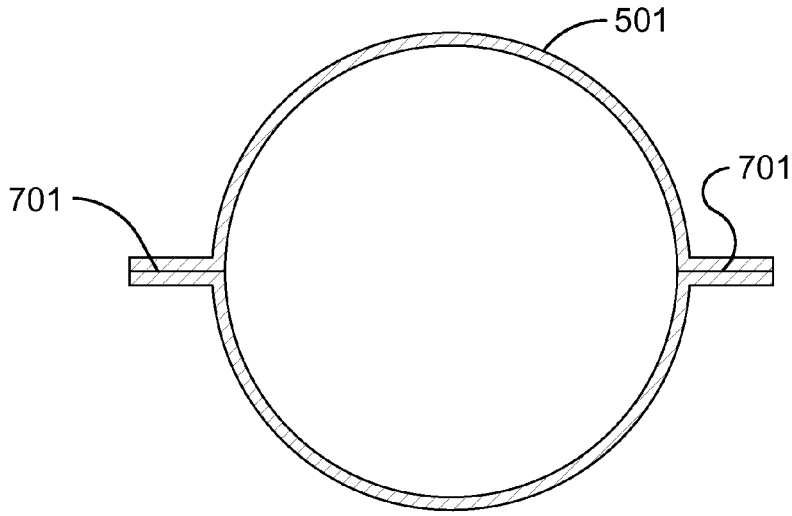
FIG. 8 depicts a top cross section cut along line 7-7 in FIG. 7 of a mast tube for a mast tube assembly made by a double butt seam for a multi-functional, personal flotation device, based on FIG. 7.

The mast tube assembly 201 can be made by extruding a tube member 501 of thin, strong plastic or sealing a flat sheet of suitable gas tight material into a tube member 501 utilizing one or more butt seams 701 as shown in cross section in FIG. 8, or a lap seam 502 as shown in cross section in FIG. 6. The seams 502, 701 can be accomplished by heat sealing, radio frequency (RF) sealing, using an adhesive or stitching and utilizing a stitching sealant. A suitable adhesive and/or stitching sealant such as a urethane adhesive is provided by Hodgman, part of The Coleman Company Inc, Wichita Kans.

Figure 4:
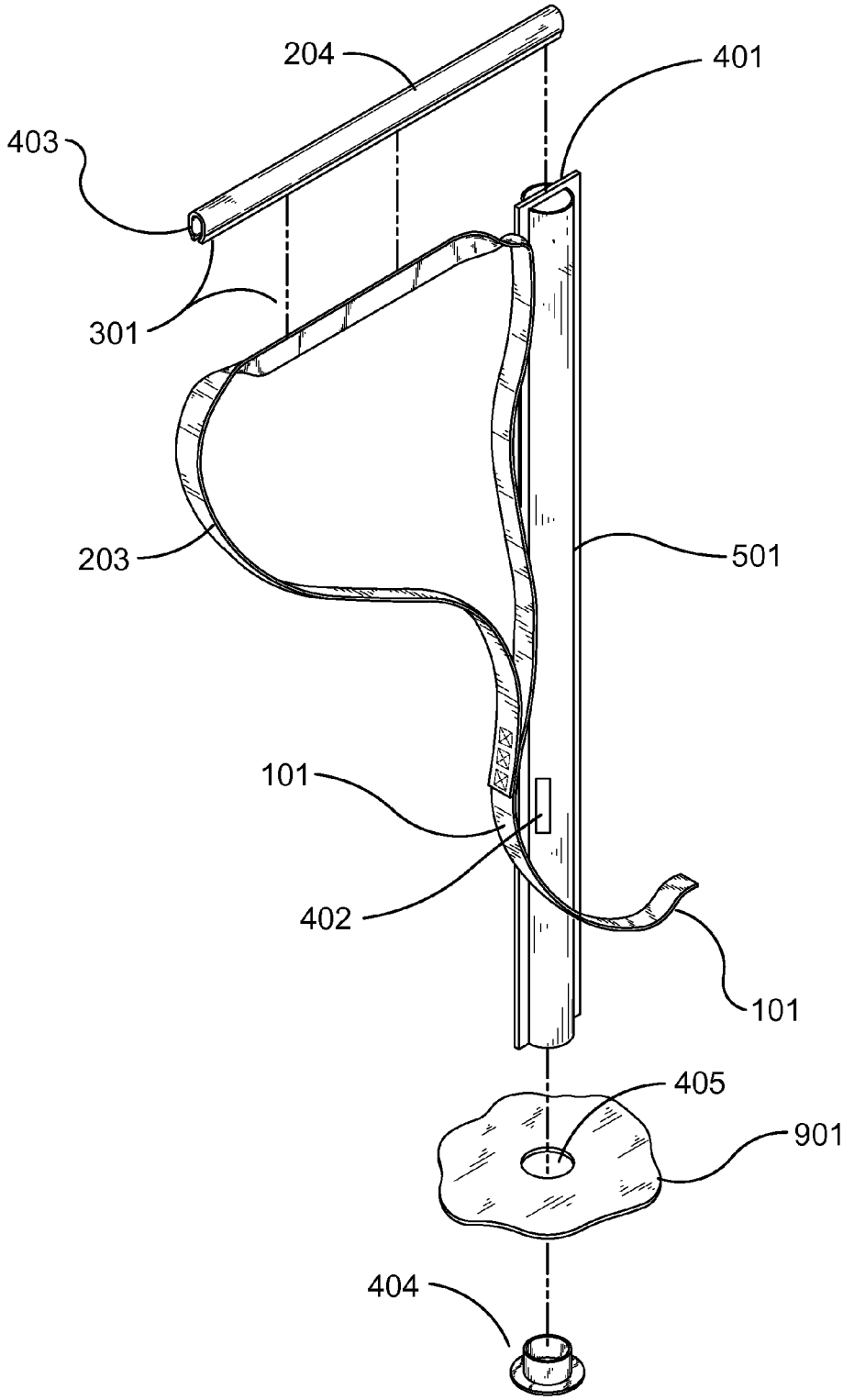
FIG. 4 depicts an exploded perspective view of mast head with a cross member and a tether loop for a multi-functional, personal flotation device in a deployed position.

With reference to FIG. 4, the mast tube assembly 201 includes the tube member 501 sealed on a distal end or mast head 401 that is adjacent to or at a cross member assembly 301, with the butt seam 701 or other appropriate seam, to create a sealed tube or mast tube assembly 201 capable of being inflated in conjunction with a buoyancy chamber 205 of the life preserver 110 for the personal flotation device 200. Additionally, it is well known in the art that such masts may incorporate visual or radio signaling devices including the mast tube assembly 201 of this invention.

The cross member assembly 301 is secured to the mast head 401. More particularly, the cross member assembly 301 includes cross member 204 secured to mast head 401 by thermal or RF welding or use of a suitable adhesive. The tether loop 101 is secured to tube member 501 of mast tube assembly 201 at area 402. A portion of the loop 203 is slidably mounted within a receiving slot 403 of the cross member 204.

Oppositely disposed from cross member assembly 301 on tube member 501, coated fabric 901 forming the wall of the buoyancy chamber 205 receives a collar 404 through aperture 405. The tube member 501 slides over bushing flange on the collar 404 and is secured thereto by thermal or RF welding or use of a suitable adhesive.

In connecting the mast tube assembly 201 to the buoyancy chamber 205, several methods may be employed as shown in the examples. In general there is at least one seal between the mast tube assembly 201 and the buoyancy chamber 205. The seals may be accomplished by heat, radio frequency welding, adhesive or stitching or sealing depending upon the material chosen for the buoyancy chamber wall 901 and the inflatable mast tube 501. A suitable seal made by heat or RF welding may require coating both sides of the fabric with urethane or vinyl.

There must be gas communication between the buoyancy chamber 205 and the inflatable mast tube 501, so that the mast tube assembly 201 is inflated with the buoyancy chamber 205. This can be accomplished by the chamber aperture 405 in the buoyancy chamber wall 901.

As shown in FIG. 3 and FIG. 4, at the top of the mast tube assembly 201, there is preferably a cross member 204 to open and extend the loop 203 and present a larger target for acquisition by the rescuer (not shown) of the wearer 102. As will become readily apparent, this cross member 204 is relatively stiff and supporting within the plane of the inflated mast tube 501 and cross member 204 and positioned at approximately right angles to the inflated tube member 501 to provide adequate horizontal support for the loop 203 once the mast tube assembly 201 is deployed.

Preferably the cross member 204 is flexible in a direction perpendicular to the plane formed by the tube member 501 and cross member 204 to facilitate bending once folded into the uninflated PFD 200. A typical cross member 204 may be made of metal, plastic, wood or other material and have a solid cross section. Preferably, the cross member 204 in general has an open or slotted cross section, where the opening or receiving slot 403 in the cross member 204 can be used to capture the loop 203 in a permanent or a releaseable fashion forming the cross member assembly 301.

The tether 101 may be fabricated of any flexible rope, line or strapping. Preferably it is a web material that will lie flat when folded. Such webbings are typically made of nylon, polyester or polypropylene. Polypropylene is the preferred material for the looped tether 101 of the personal flotation device 100 because of its ability to float in water. Nylon or polyester is the preferred material for the tether loop 101 of the personal flotation device 200 because of its greater strength and lack of a floating requirement. Although webbing is used in the following description, other suitable ropes, lines or wires may be substituted.

One end of the tether 101 forms the loop 203 by securely attaching the webbing back onto itself. This is typically accomplished by stitching although other connection methods such as stapling, riveting, splicing or swaging a fitting may be used. The other end of the tether 101 is securely fastened to back strap 113 of the harness belt 111, typically above and behind the head of the wearer 102 as shown in FIG. 21, again typically by stitching, although other connection methods such as stapling, riveting, or splicing may be used. The size of the webbing is preferably small and light enough to not hinder mast inflation and extension and yet large enough to prevent breakage and provide a secure attachment preferably to the back strap 113 of the harness belt 111 encompassing the wearer 102.

Figure 5:
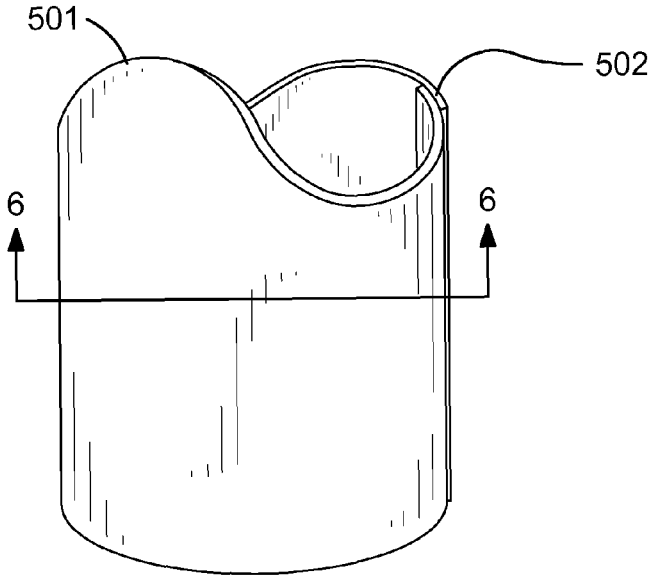
FIG. 5 depicts a perspective cross section of a mast tube made by a lap seam for a multi-functional, personal flotation device.

With reference to FIGS. 5 and 6, the lap seam 502 is shown as forming tube 501. As tube 501 is formed in this fashion, edges of material to form tube 501 are overlapped and sealed together. Then the tube 501 may be used in the mast tube assembly 201. A suitable seal made by heat or RF welding may require double coating of the fabric by applying urethane or vinyl to both sides of the fabric.

Figure 7:
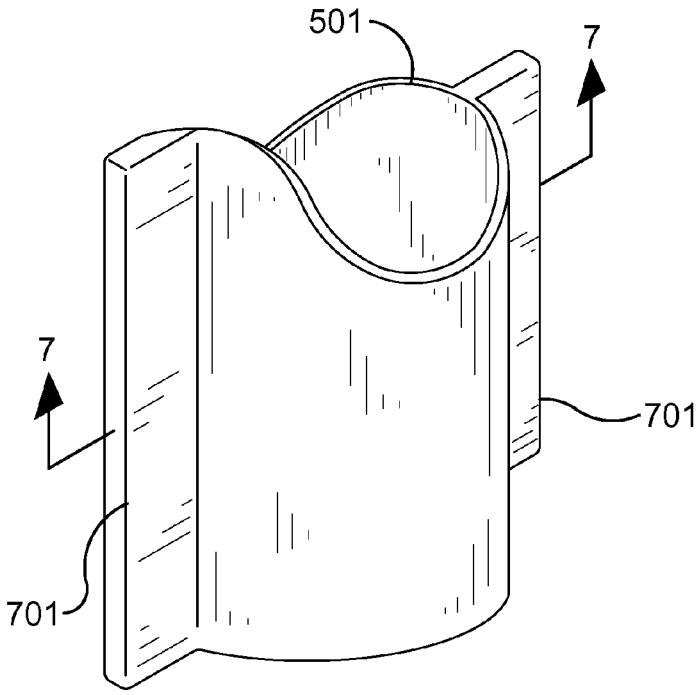
FIG. 7 depicts a perspective top cross section of a mast tube for a mast tube assembly made by a double butt seam for a multi-functional, personal flotation device.

With reference to FIGS. 7 and 8, two butt seams 701 are shown as forming tube 501. As the tube 501 is formed in this fashion, edges of material to form tube 501 are placed edge to edge and sealed together. Then tube 501 may be used in mast tube assembly 201. In contrast to the lap seam shown in FIGS. 5 and 6, a suitable seal can be made in a butt seam utilizing fabric coated only on one side with vinyl or urethane when those sides are juxtaposed prior to sealing. Of course, the tube 501 may be formed with a single butt seam by folding the tube material upon itself before sealing the open edge. From an ease of manufacturing standpoint, a double butt seam 701 as shown in FIGS. 7 and 8 is preferred.

Figure 9:
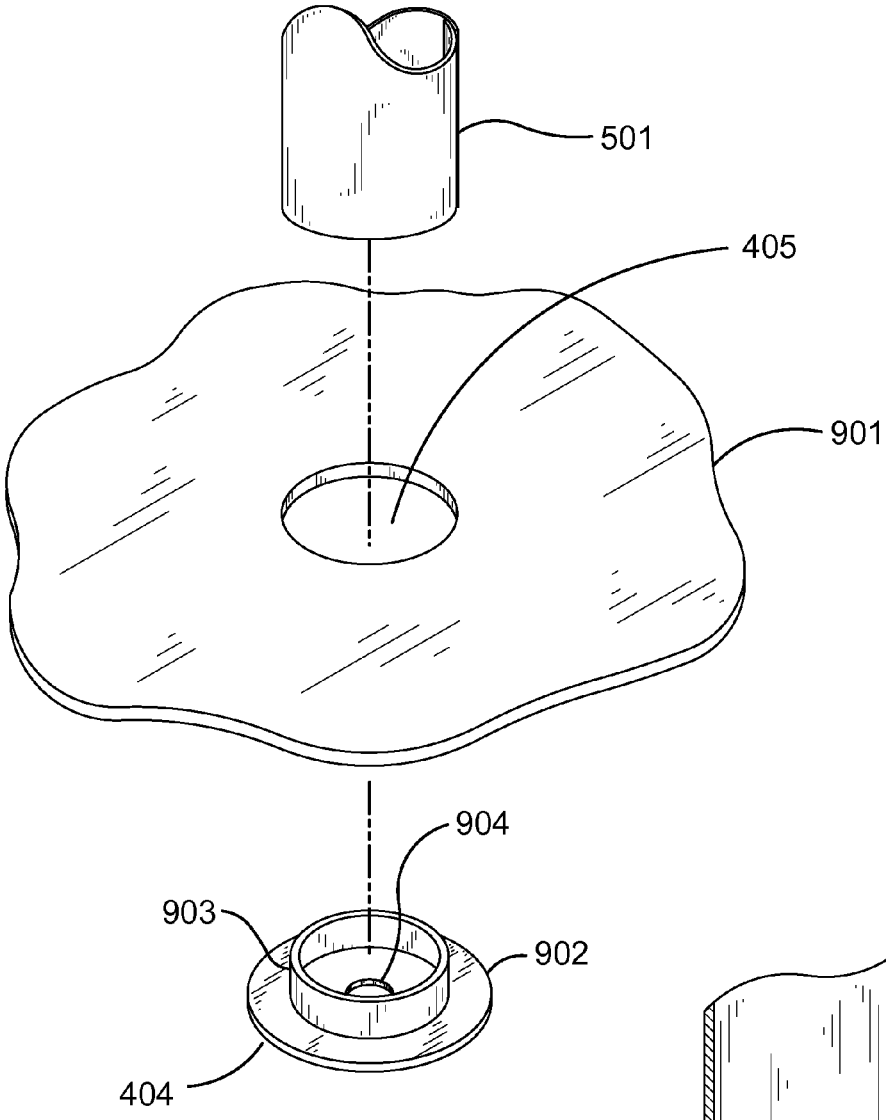
FIG. 9 depicts an exploded perspective view of mast tube for a mast tube assembly assembled to a coated fabric casing of a buoyancy chamber of a personal flotation device.
Figure 10:
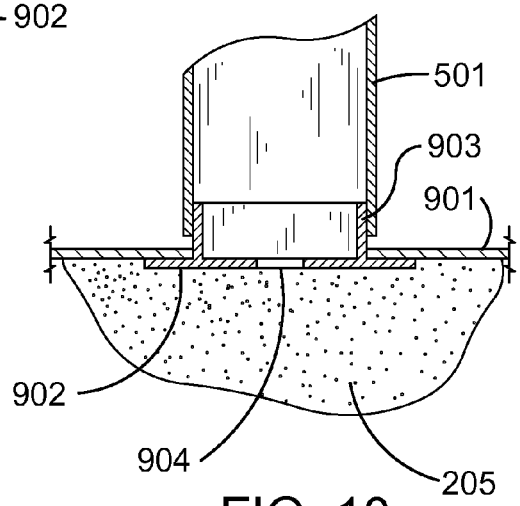
FIG. 10 depicts a side cross-section cut away view of a tube as assembled to a coated fabric casing of a buoyancy chamber of a personal flotation device, based on FIG. 9.

Adding FIGS. 9 and 10 to the consideration, the assembly of the tube 501 to the coated fabric casing 901 of the buoyancy chamber 205 as shown in FIG. 3 is detailed. Within coated fabric casing 901 is the aperture 405, which cooperates with buoyancy chamber 205 and allows fluid communication between the tube 501 and the buoyancy chamber 205. More particularly, bushing flange 902 of end bushing 404 supports bushing collar 903 passing through aperture 405. Then the collar 903 can receive tube 501 in order to provide a basis for completing the mast tube assembly 201. As buoyancy chamber 205 adjacent to aperture 405 inflates, tube 501 is also inflated.

As also shown in FIGS. 9 and 10, the end bushing 404 may be partially closed with a resulting orifice 904. The orifice 904 can be sized to slow gas flow and inflation of the mast tube 501 while the buoyancy chamber 205 inflates. The size of the orifice 904 can be selected to provide desired inflation characteristics of the mast tube assembly 201.

Figure 11:
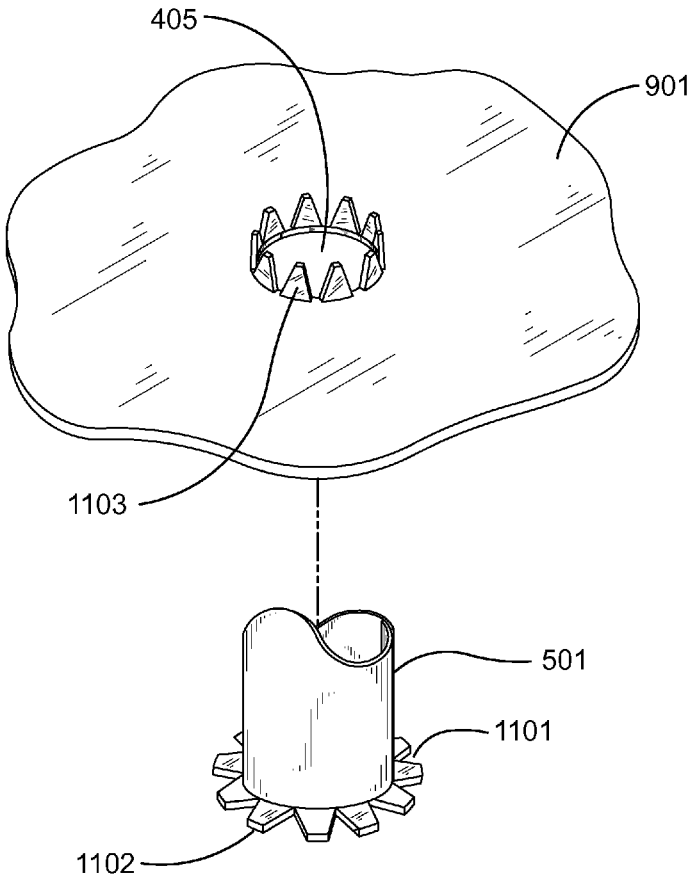
FIG. 11 depicts an exploded perspective view of a tube assembled to a coated fabric casing of a buoyancy chamber of a personal flotation device in a second embodiment.
Figure 12:
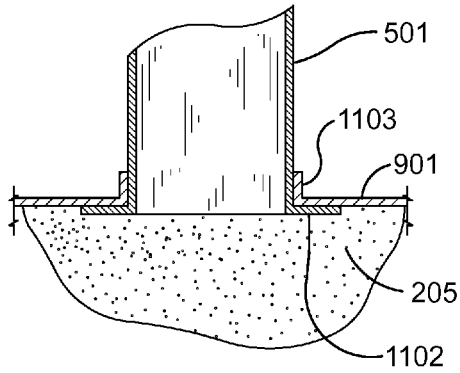
FIG. 12 depicts a side, cross-section view of a tube assembled to a coated fabric casing of a personal flotation device, based on FIG. 11.

Still, another variation in connection of the mast tube assembly 201 and buoyancy chamber 205 is shown in FIGS. 11 and 12. The tube 501 includes a tabbed tube lip 1102, which serves to replace the end bushing 404 in FIGS. 9 and 10. The mast tube 501 is prepared whereby several short longitudinal cuts 1101 are made in the bottom of the mast tube 501 and the resulting mast tabs 1102 are splayed out. The buoyancy chamber 205 is similarly prepared as shown in perspective in FIG. 11 where an aperture 405 is formed in the buoyancy chamber wall 901 by a series of radial cuts and splaying the resulting buoyancy tabs 1103 open and upwards.

Assembly of the mast tube 501 into the buoyancy chamber 205 is shown in cross section in FIG. 12.

Figure 13:
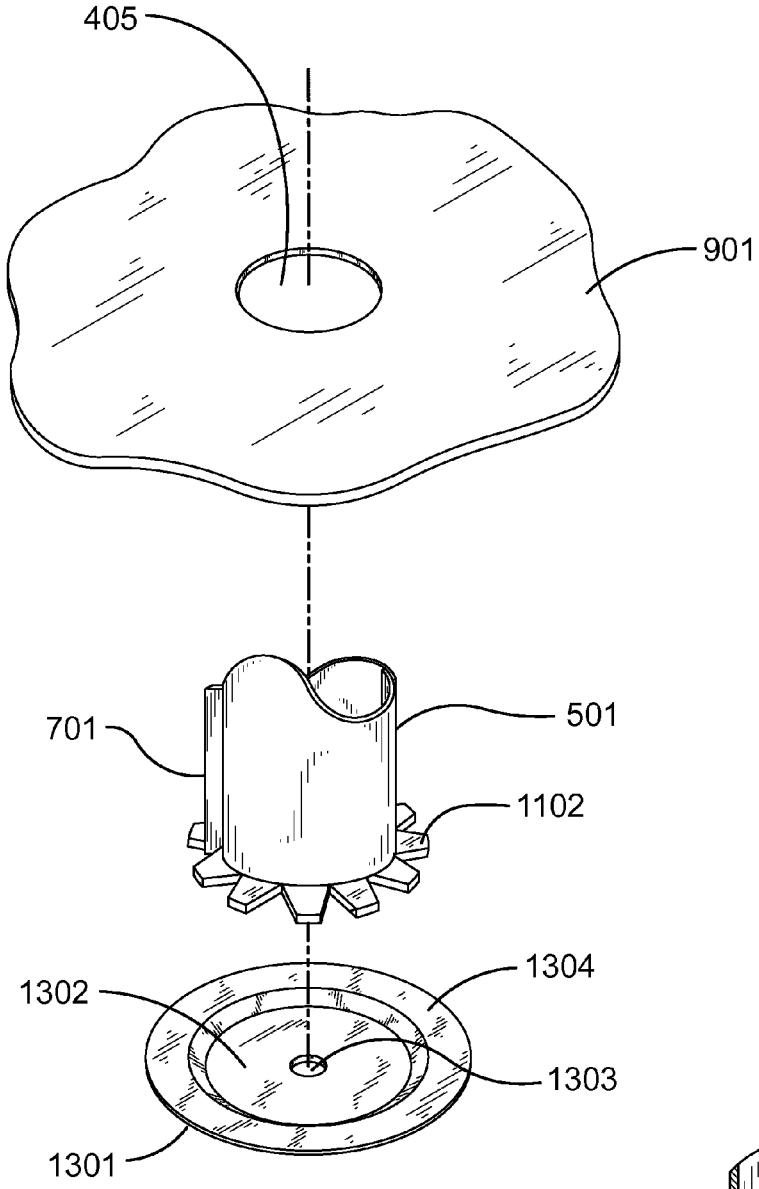
FIG. 13 depicts an exploded perspective view of a tube assembled to a coated fabric casing of a buoyancy chamber of a personal flotation device in a third embodiment.
Figure 14:
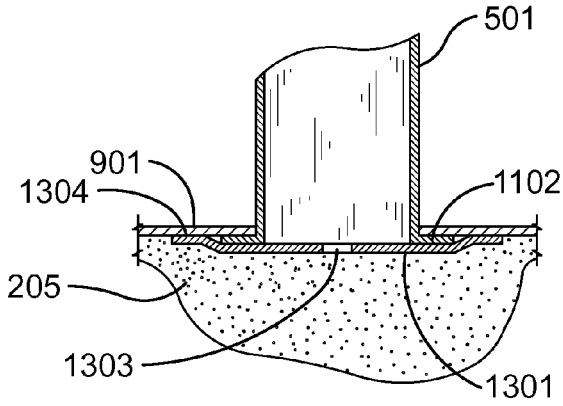
FIG. 14 depicts a side cross-section view of a tube assembled to a coated fabric casing of a buoyancy chamber of a personal flotation device, based on FIG. 13.

As a variation of FIGS. 13-14, the tube 501 with the tube lip tabs 1102 is supported in position in the buoyancy chamber 205 with an aperture patch 1301 preferably of a flexible material such as urethane coated nylon. The aperture patch 1301 has a centrally located lip receiver 1302, which accepts the tube tabs 1102. Extending beyond the lip receiver 1302 is a sealing edge 1304 to be sealed to chamber side and hold tube 501 in position. Centrally located in lip receiver 1302 is a patch orifice 1303. The patch orifice 1303 provides communication for the inflating gas of buoyancy chamber 205 with mast tube assembly 201 in general and the tube 501 in particular.

The patch orifice 1303 will slow gas flow from the buoyancy chamber 205 to the mast tube assembly 201 and slow inflation of the tube 501. While a large aperture will result in almost simultaneous inflation of the buoyancy chamber 205 and the mast tube assembly 201; patch orifice 1303 provides for a slower and possible more efficient, controlled inflation of the tube 501. The size of patch orifice 1303 may be modified to achieve the desired inflation characteristics of the mast tube assembly 201.

Common to all constructions, the mast tube assembly 201 is preferably positioned on the buoyancy chamber 205 so that it is approximately vertical once deployed. This can be accomplished by attaching the mast tube assembly 201 perpendicular to a portion of the buoyancy chamber 205 that will be horizontal when deployed and worn by the wearer 102. Alternatively, the mast tube assembly 201 can be attached at an appropriate angle to a portion of the buoyancy chamber 205 that is not horizontal when deployed and worn by the wearer 102 such that the angle of mast tube assembly 201 attachment renders the mast tube assembly 201 approximately vertical.

Typically, uninflated buoyancy chambers 205 of the personal flotation device 100 are folded into thirds, or partitions, and back upon themselves to create a folded width of about five to about 11 centimeters (two to four inches). The folded buoyancy chambers 205 are then usually secured and designed to open upon pressure applied by the inflating buoyancy chambers 205 once the inflation mechanism is activated. It is important to maintain compact size and light weight after the addition of the looped tether 101 or the mast tube assembly 201 so that comfort of the wearer is not impaired.

Figure 15:
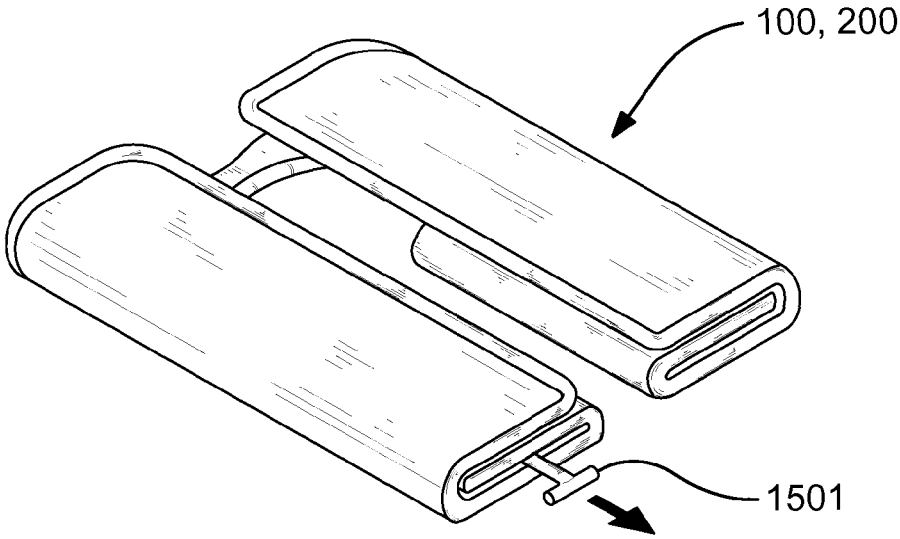
FIG. 15 depicts a perspective view of a folded, uninflated version of a personal flotation device.
Figure 16:
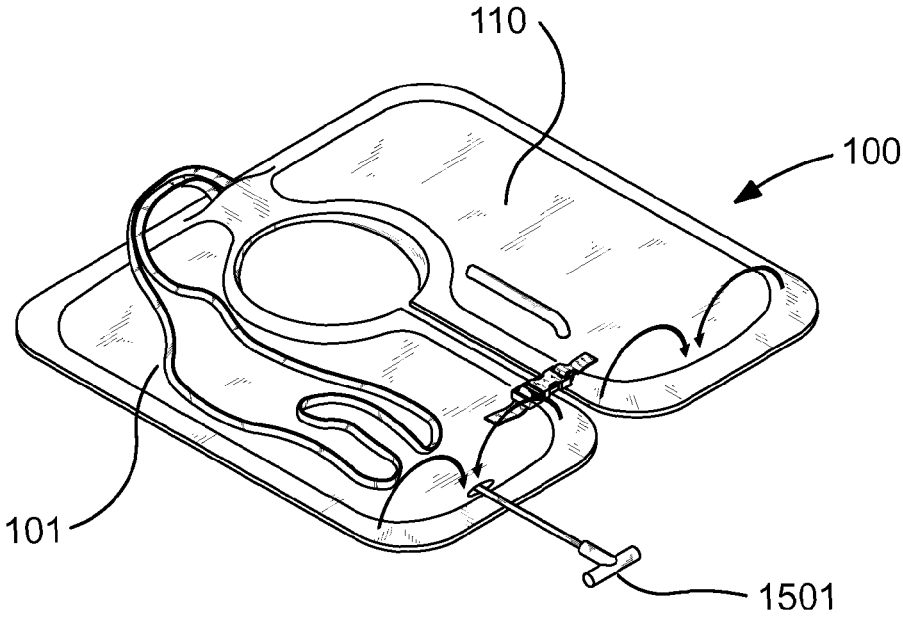
FIG. 16 depicts a perspective view of an open, uninflated personal flotation device.

FIGS. 15 and 16 show the assembly of the life preserver 110 and the looped tether 101 to form the personal flotation device 100. A pull tab 1501 allows the wearer 102 to manually deploy the life preserver 110 in an emergency. Preferably the life preserver 110 is equipped with an automatic inflation mechanism as is well known in the art. A preferred folding method is to fold the looped tether 101 back and forth into a folded position prior to folding and closure of the personal flotation device 100. This allows for automatic deployment of the looped tether 101 upon inflation of the buoyancy chambers 205 and opening of the cover.

Figure 17:
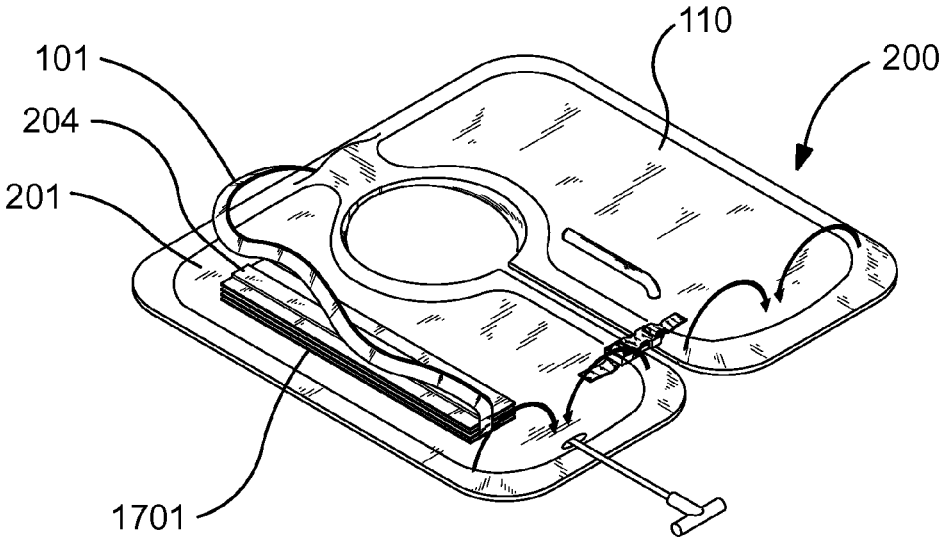
FIG. 17 depicts a perspective view of an open, uninflated personal flotation device.
Figure 18:
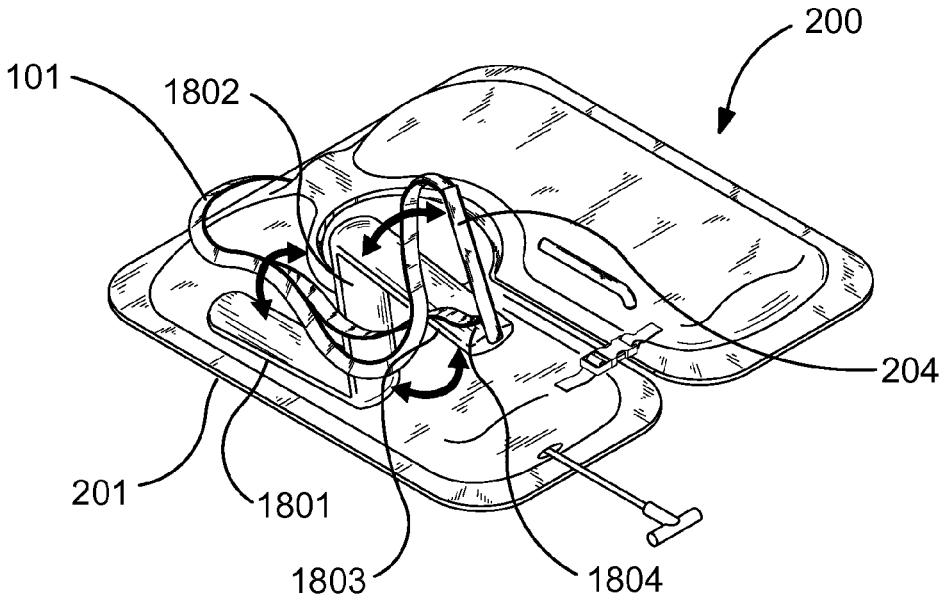
FIG. 18 depicts a perspective view of an open, partially inflated personal flotation device.

As shown in FIGS. 15, 17 and 18, the assembly of the life preserver 110 and the mast tube assembly 201 to form personal flotation device 200. The pull tab 1501 allows the wearer 102 to manually deploy the life preserver 110 in an emergency. Preferably, the life preserver 110 is equipped with an automatic inflation mechanism as is well known in the art. A preferred folding method illustrated in FIG. 18 is to fold the mast tube assembly 201 back and forth into folded position 1701 upon itself with the last fold 1804 at a substantially 45-degree angle to the first fold 1801, second fold 1802 and third fold 1803 in order to position the cross member 204 lengthwise along the previously folded layer or the underlying folds of the mast tube assembly 201. The exact number of folds prior to the last fold is not important and is shown here for illustration only.

The folded position 1701 in FIG. 17 allows a compact arrangement that does not significantly affect the bulk or flexibility of the personal flotation device 200 and maintains comfort for the wearer 102.

Figure 19:
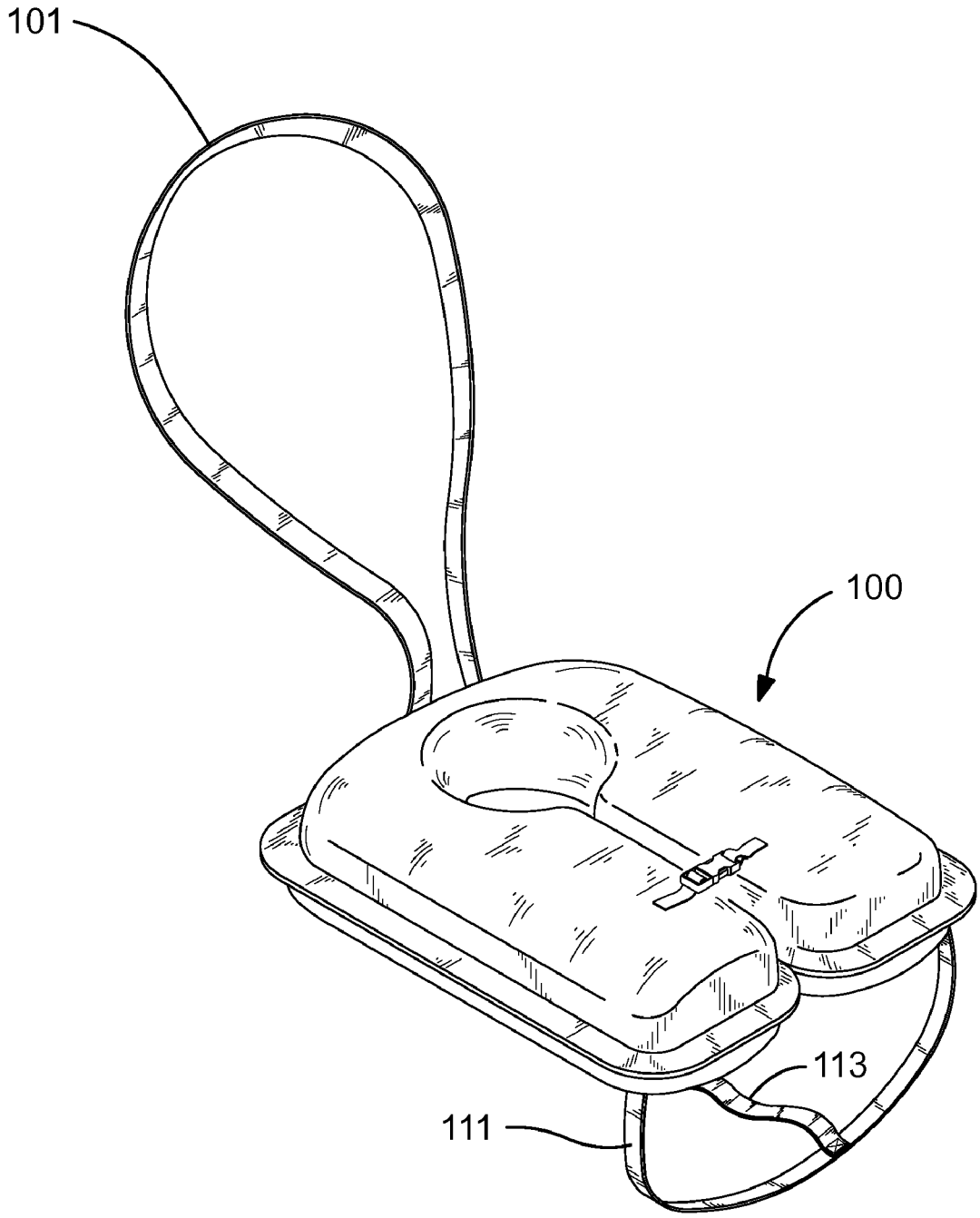
FIG. 19 depicts a perspective view of an open, inflated personal flotation device.

FIG. 19 shows the personal flotation device 100 in the fully deployed position. Folding of the looped tether 101 within the cover of the PFD as shown in FIG. 16 permits deployment of the looped tether 101, once the life jacket is opened by inflation.

Figure 20:
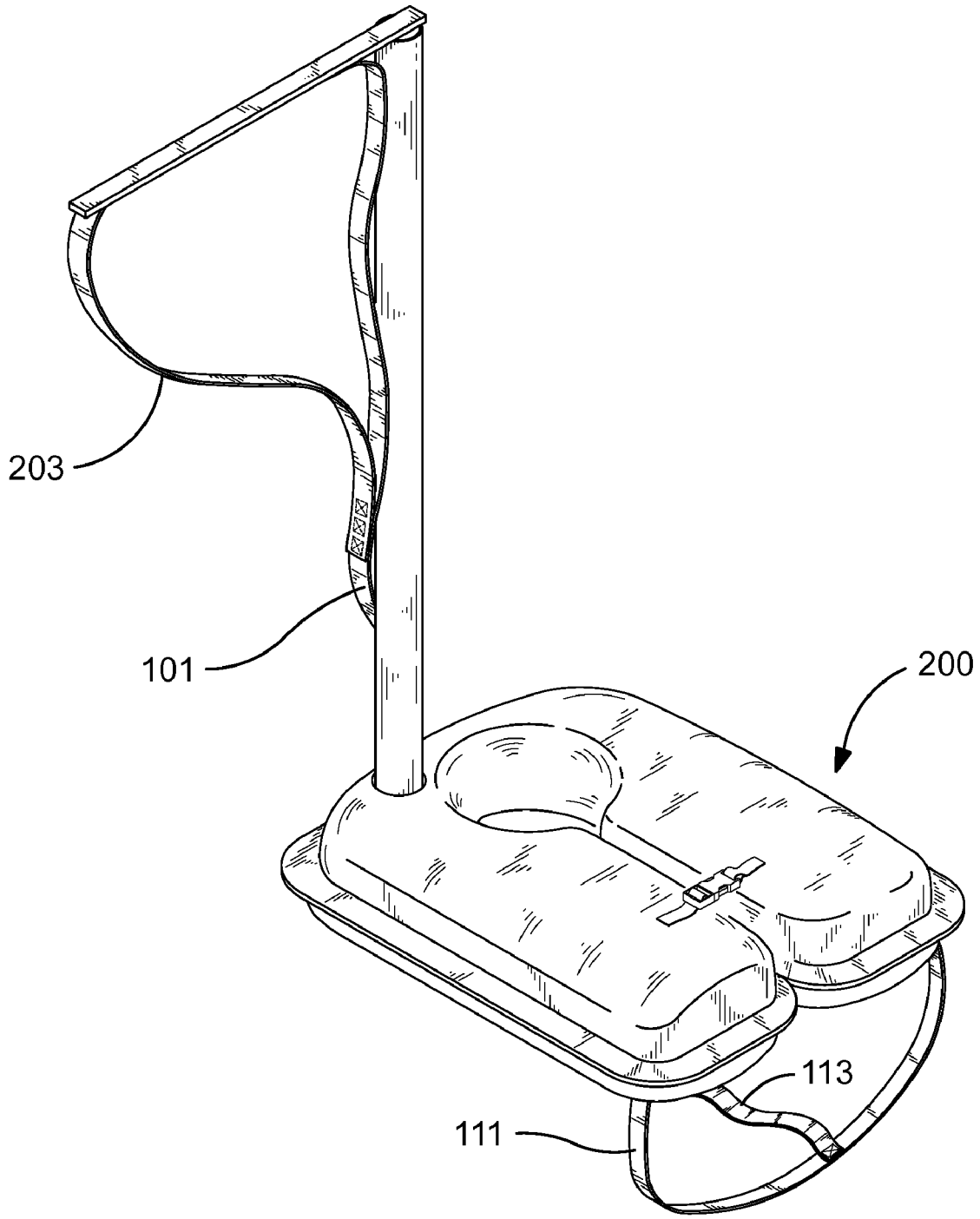
FIG. 20 depicts a perspective view of an open, inflated personal flotation device.

FIG. 20 shows the personal flotation device 200 in the fully deployed position with the mast tube assembly 201 fully extended and the loop 203 available for acquisition by the rescuer. Folded position 1701 of FIG. 17 has proceeded to the fully deployed position, especially thanks to the previously above described folded assembly in FIG. 18.

FIG. 21 shows a rear perspective view of the personal flotation device 100,200 attached to a user 102. The harness belt 111 includes a vertical strap 113 that extends up the back of a user. An end of the looped tether 101 is preferably attached to the vertical strap 113 with stitching 172.

The inventive points will be made clear in the following examples, which illustrate, without unduly limiting the invention.

Example One

One such multi-functional PFD with integrated tether is shown in deployed position in FIG. 1. Multi-functional PFD 100 is formed with a tether of 1" wide, high strength (900#) polypropylene flat webbing approximately 10' long and with both ends of the tether 101 securely stitched to the back strap 113 of the automatically inflated PFD 110 forming a tether loop of approximately 36" in diameter when deployed. This tether is folded onto the deflated buoyancy chamber prior to folding of the chamber and closure of the PFD 110 as shown in FIG. 16. Upon the MOB entering the water, the PFD is automatically activated, the buoyancy chambers inflate and unfold discharging the tether into the water. The polypropylene tether floats and provides a convenient and safe target for acquisition and recovery of the MOB by the rescuer.

Example Two

One such mast and tether system, shown in deployed position in FIG. 2, employs a collar 404 that is sealed by urethane adhesive to both the underside of the coated fabric casing 901 of buoyancy chamber 205 and the inside of the inflatable mast tube 501 as shown in cross section in FIG. 10. In this example, the mast tube 501 is formed with a lap seam 502. The collar 404 has an aperture 904 equal to the inside diameter of the collar bushing 903 providing a collar of "L" shaped cross section. The tether 101, of about 1.25 centimeters (0.5 inch) wide flat nylon webbing forms a tether loop 203 by stitching 172 and is securely attached along the length of the mast tube 501 by urethane adhesive. The top of the mast tube assembly is closed with a butt seam 701 to which the flat plastic cross member 204 of about 0.3 centimeter thick by about 2 centimeter wide by about 15 centimeters long is securely attached with adhesive. The tether loop 203 is securely attached to the cross member 204 by urethane adhesive. The opposite or fastening end of the tether 101 is securely attached to the back strap 113 of the harness 111 of the PFD 110 by stitching 172.

This example provides a mast tube assembly 201 that rapidly inflates concurrently with the buoyancy chambers 205 and with both the tether 101 and cross member assembly 301 securely attached to the mast tube 501. This is a less useful construction than the preferred embodiment because a rigid or semi rigid collar 404 may impair a flat profile upon folding, while manipulation of the cross member assembly 301 and tether loop 203 may cause strain on the mast tube 501 and possible failure of a seam 701 or 502 resulting in deflation of buoyancy chambers 205 and loss of flotation.

Example Three

Another mast tube assembly 201 is connected to the buoyancy chamber 205 without the use of a collar. In this example, the mast tube 501 is formed with a lap seam 502. Referring now to FIG. 11, several short longitudinal cuts 1101 are made in the bottom of the mast tube 501 and the resulting mast tabs 1102 are splayed out. The coated fabric of the buoyancy chamber 901 is similarly prepared as shown in perspective in FIG. 11 by formation of an aperture 405 by a series of radial cuts in the coated fabric of the buoyancy chamber 901 and splaying the resulting buoyancy tabs 1103 open and upwards. Assembly of the mast tube into the PFD is shown in cross section in FIG. 12. In this assembly the tube member 501 of mast tube assembly 201 is inserted through the buoyancy chamber aperture 405 formed in the coated fabric of the buoyancy chamber 901. The mast tabs 1102 are flattened or spread at the splayed end of the tube member 501 and are heat sealed to inner side of the coated fabric of the buoyancy chamber 901. The buoyancy chamber tabs 1103 from the splayed buoyancy chamber circular aperture 405 are heat sealed to outside of the tube member 501. The mast tabs 1102 on the mast tube and tabs 1103 on the buoyancy chamber are offset from one another to provide a gas tight seal.

Referring now to FIGS. 3 and 4, the tether 101, of about 1.25 centimeters (0.5 inch) wide flat nylon webbing forms a tether loop 203 by stitching 172 and is attached intermittently along the length of the mast tube 501 with hook and loop type connections 402 along the length of the mast tube 501. A standard hook and loop assembly is available under the registered trademark VELCRO. The opposite or fastening end of the tether 101 is securely attached to the back strap 113 of the harness 111 of the PFD 110 by stitching 172.

The tube member 501 of mast tube assembly 201 is equipped with a cross member 204 and the tether loop 203 is attached to the open section 403 of cross member 204. In this case, the open cross section 403 of the cross member 204 can capture both the butt seam 701 at the head of the mast tube 401 and the tether loop 203 providing a simplified break away of the tether loop 203 from the cross member 204. In total, this construction allows the tether loop 203 and the tether 101 to break free of the mast tube assembly 201 when in use preventing undue strain on the tube member 501 and potential failure of the seal formed in the buoyancy chamber aperture 405 by the coated fabric of the buoyancy chamber 901 and the mast tube 501.

This example provides a mast tube assembly 201 that rapidly inflates concurrently with the buoyancy chambers 205 and with both the tether 101 and tether loop 203 being releasably attached the mast tube 501. This system is generally preferred over Example 2 because it does not place strain on the mast tube assembly 201 when the tether loop 203 is in use by the rescuer and without the use of a collar assembly 404 it will also fold flatter and more compact in the deflated, non-deployed state.

Example Four

Another mast tube assembly 201 allows for a more controlled inflation of the mast tube 501. In this assembly, the mast tube 501 is prepared with a double butt seam 701 as shown in FIG. 7. A double butt seam is more easily manufactured than a lap seam. The base of the mast tube 501 prepared according to Example 3 resulting in a series of mast tabs 1102 as shown in FIG. 11. Referring now to FIG. 13, the buoyancy chamber fabric cover 901 is prepared by formation of a simple circular aperture 405 of diameter slightly larger than that of the inflated mast tube 501.

Assembly of the mast tube 501 into the PFD 200 is shown in cross section in FIG. 14. The mast tube 501 is inserted through the aperture 405 in the buoyancy chamber fabric cover 901. The mast tabs 1102 of the base of the mast tube 501 are heat sealed to inner surface of the buoyancy chamber coated fabric 901. The opening to the mast tube 501 is covered by an apertured patch 1301 that is heat sealed to both the buoyancy tabs 1102 and the inner surface of the buoyancy chamber fabric cover 901. The patch 1301 has an aperture 1303 cut into it to provide controlled inflation gas flow into the mast tube 501.

Referring now to FIG. 4, the tether 101, of about 2 centimeters wide flat nylon webbing forms a tether loop 203 by stitching 172 and is attached intermittently along the length of the mast tube 501 with frangible staples that penetrate both the tether 101 and the butt seam 701 of the mast tube 501 being careful not to puncture the gas compartment of the mast tube. The opposite or fastening end of the tether 101 is securely attached to the back strap 113 of the harness 111 of the PFD 110 by stitching 172.

The top of the mast tube assembly 201 is equipped with a hollowed cross member 204 as shown in perspective in FIG. 4. The tube member 501 of mast tube assembly 201 is equipped with a cross member 204 and the tether loop 203 is attached to the open section 403 of cross member 204. In this case, the open cross section 403 of the cross member 204 can capture both the butt seam 701 at the head of the mast tube 501 and the tether loop 203 providing a simplified break away of the tether loop 203 from the cross member 204. In total, this construction allows the tether loop 203 and the tether 101 to break free of the mast tube assembly 201 when in use preventing undue strain on the tube member 501 and potential failure of the seal formed in the buoyancy chamber aperture 405 by the coated fabric of the buoyancy chamber 901 and the mast tube 501. This is the preferred embodiment because the mast tube assembly 201 will fold compactly and also provide for a controlled inflation of the mast tube 501 once deployed.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure. Because of this disclosure and solely because of this disclosure, modification of this tool can become clear to a person having ordinary skill in this particular art. Such modifications are clearly covered by this disclosure.

I claim:

1. A multi-functional, personal flotation device providing personal support, comprising:

a life preserver;

a casing being folded over at least once to form a folded over section, said life preserver being retained in said folded over section;

means for inflating said life preserver; and a tethering loop, substantially all of said tethering loop being retained inside and covered by said at least one folded over section, said tethering loop being secured to said life preserver, substantially all of said tethering loop being automatically released from inside said at least one folded over section when said inflatable life preserver is inflated, wherein said tethering loop extending from said inflatable life preserver for grasping by a grappling hook.

2. The multi-functional, personal flotation device providing personal support of claim 1, further comprising:

a harness extending from said life preserver, said harness being secured around a wearer.

3. The multi-functional, personal flotation device providing personal support of claim 1, further comprising:

said inflatable life preserver having at least one buoyancy chamber.

4. A multi-functional, personal flotation device providing personal support, comprising:

a life preserver;

a casing being folded over on at least one of two ends to form a folded over section, said life preserver being retained in said at least one folded over section;

means for inflating said life preserver;

an inflatable tube having one end in fluid communication with said life preserver;

a tethering loop being retained on the other end of said inflatable tube, said inflatable tube extending from said life preserver when said life preserver is inflated, a portion of said tethering loop being located away from said inflatable tube.

5. The multi-functional, personal flotation device providing personal support of claim 4, further comprising:

a harness extending from said life preserver, said harness being secured around a wearer.

6. The multi-functional, personal flotation device providing personal support of claim 4, further comprising:

said inflatable life preserver having at least one buoyancy chamber.

7. The multi-functional, personal flotation device providing personal support of claim 6, further comprising:

said inflatable tube being foldable in a deflated state for retention under said at least one folded section.

8. The multi-functional, personal flotation device of claim 4, further comprising:

a cross member extending from the other end of said inflatable tube, a portion of a length of said tether loop being retained along a portion of a length of said cross member.

9. The multi-functional, personal flotation device of claim 4, wherein:

said at least one buoyancy chamber and said inflatable tube being permanently gas tight and attached in to each other in a gas tight manner and allowing gas fluid communication.

10. The multi-functional, personal flotation device of claim 4, wherein:

said inflatable tube having a substantially vertical orientation when inflated.

11. The multi-functional, personal flotation device of claim 4 further comprising:

said inflatable tube being formed from a strong, flexible, gas proof plastic material.

12. The multi-functional, personal flotation device of claim 4 further comprising:

said inflatable tube being formed with one of a lap seam and at least one butt seam.

13. The multi-functional, personal flotation device of claim 4, further comprising:

a signaling device attached to said inflatable tube, said signaling device being at least one of a light, a noise maker and a reflective surface.

14. The multi-functional, personal flotation device of claim 8, wherein:

a receiving slot being formed in an end of said cross member, said tether loop being slidably engaged with said receiving slot.

15. The multi-functional, personal flotation device providing personal support of claim 4, further comprising:

an end bushing including a bushing collar extending from a bushing flange, said bushing collar being inserted through an aperture in said life preserver and casing, an inner perimeter of said inflation tube receiving said bushing collar.

16. The multi-functional, personal flotation device providing personal support of claim 15, wherein:

a flange aperture being formed through said bushing flange, said flange aperture being smaller than said aperture in said life preserver to moderate gas flow into said inflatable tube.

17. The multi-functional, personal flotation device providing personal support of claim 8, wherein:

said cross member being flexible in a direction perpendicular to a plane formed by said inflatable tube and cross member in order to facilitate bending thereof in a substantially flat parallel relationship with said life preserver.

18. The multi-functional, personal flotation device of claim 6 further comprising:

a tube lip extending radially from a bottom of said inflatable tube, said casing including a plurality of buoyancy tabs extending upward therefrom, said inflatable tube being inserted through said life preserver and said plurality of tabs, a gas tight seal being formed between said inflatable tube and said life preserver.

19. The multi-functional, personal flotation device of claim 6 further comprising:

a tube lip extending radially from a bottom of said inflatable tube, said inflatable tube being inserted through said life preserver and said casing, an aperture patch being sealed over said tube lip and an inner surface of said life preserver, patch orifice being formed through said aperture patch for communication between said life preserver and said inflation tube.

20. The multi-functional, personal flotation device of claim 6, wherein:

said at least one buoyancy chamber being folded into a first partition, a second partition and a third partition, said first partition, said second partition, and said third partition being folded back upon themselves, said folded chambers being retained within in said casing designed to open upon pressure applied by inflating the at least one buoyancy chamber as the inflation mechanism is activated.

21. The multi-functional, personal flotation device of claim 6, wherein:

said inflatable tube being folded into a plurality of folds with the last fold being at a substantially 45 degree angle to the previous folds.

* * * * *